United States Patent [19]

Short

[11] Patent Number: 4,831,706

[45] Date of Patent: May 23, 1989

[54] METHOD OF MAKING SPIRAL STAIRCASES

[75] Inventor: Mark Short, Clearlake, Calif.

[73] Assignee: Floor to Floor, Inc., Clearlake, Calif.

[21] Appl. No.: 170,842

[22] Filed: Mar. 21, 1988

[51] Int. Cl.[4] ..... B23Q 17/00

[52] U.S. Cl. ..... 29/407; 52/187; 52/741; 29/521

[58] Field of Search ..... 29/400 M, 407, DIG. 3, 29/521; 52/182, 187, 593, 646, 726, 741; D25/63

[56] References Cited

U.S. PATENT DOCUMENTS

| | | | |
|---|---|---|---|
| D. 251,805 | 5/1979 | Allmand | D25/63 |
| 786,431 | 4/1905 | DeWitt | 52/187 |
| 3,964,222 | 6/1976 | Geleijnse et al. | 52/187 |
| 4,041,662 | 8/1977 | Ward | 52/187 |
| 4,285,178 | 8/1981 | Holzkämpfer et al. | 52/187 |
| 4,296,577 | 10/1981 | Schvette | 52/187 |
| 4,373,609 | 2/1983 | De Donato | 182/178 |

*Primary Examiner*—Timothy V. Eley

*Attorney, Agent, or Firm*—Steven E. Kahm

[57] ABSTRACT

A method of constructing a spiral staircase to the specifications of an architect comprising the steps of taking a plurality of flat rectangular sheets of metal and cutting the front edge at an angle to form the front edge of a tread. Then cutting a pair of stringers in the sheet of metal and bending the stringers downward until they are perpendicular to the tread. Then cutting a riser at the back of the sheet of metal and bending the riser upward. Once a plurality of sheets of metal are formed as outlined above they may be assembled by attaching the stringers of one sheet to the risers of another, forming a spiral staircase. A base for the staircase to rest on and attach the first step to should be employed. The base should be attached to the floor. The base may be made from a rectangular sheet of metal by cutting the front edge at the same angle as the front edge of the tread and then bending a front and rear support for the base in the sheet of metal. At the top of the stairs a plate should be attached to the floor and to the staircase to hold the staircase in place.

12 Claims, 4 Drawing Sheets

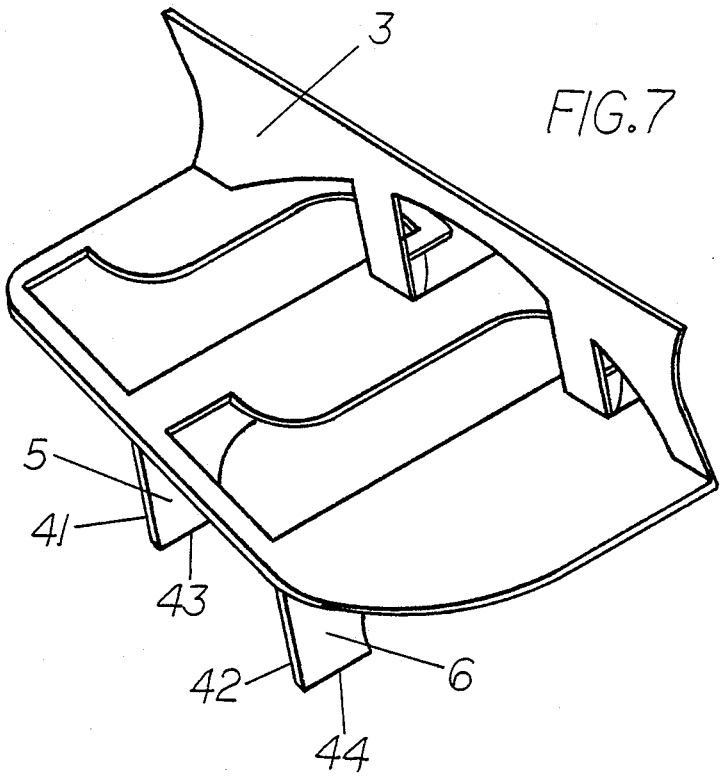
FIG. 7
FIG. 8
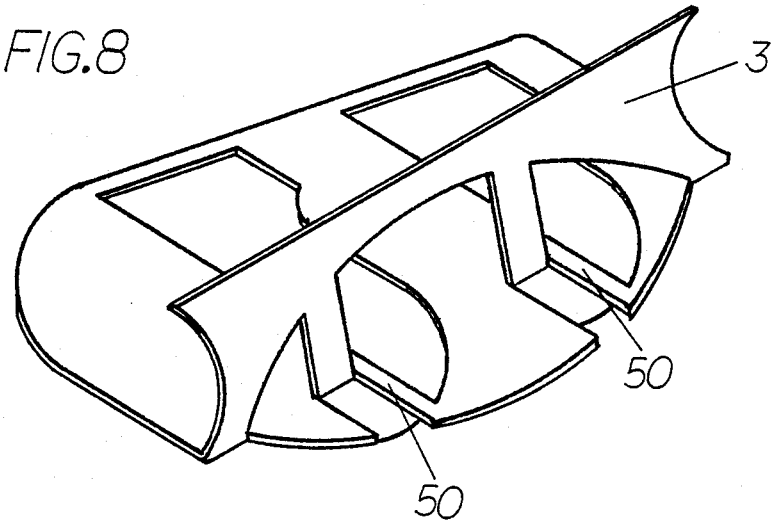

METHOD OF MAKING SPIRAL STAIRCASES

BACKGROUND OF THE INVENTION

Most staircases in houses and other structures are made by carpenters who make the staircases on the site out of wood. The staircases are usually straight and are relatively easy to make. The staircases are usually supported on one side by a wall and on the other by a support structure. When a carpenter is asked to construct a spiral staircase it requires special skills that he may not possess.

Further most spiral staircase designs use a central post with the stairs radiating in rotating fashion from the center post. The use of the center post gives the stair structure strength and stability but results in a tight turn for the user as he travels the stairs making his path in circles right next to the center post.

Some architects desire a more free standing style, one which does not use a center post so as to have stairs with a less cluttered more free standing look. Another advantage of not having a center post is having stairs beginning several feet from the center of the circle. This provides a spiral which does not have the tight turns associated with spiral staircases having a center post and makes it easier to use the stairs.

Since wooden stairs generally would not have the strength to support this style of stairs, these stairs are usually made of metal.

The present invention is a method of producing a spiral staircase form flat sheets of metal to the specifications of an architect.

SUMMARY OF THE INVENTION

This invention relates to the construction of spiral staircases. By using the method disclosed a strong free standing spiral staircase can be constructed from flat sheets of metal to the specifications desired for a particular building project.

The method disclosed is to take a flat sheet of metal and cut the front edge at an angle to form the front edge of a tread. Then cut a pair of stringers in the sheet of metal and bend the stringers downward until they are perpendicular to the tread. Then cut a riser at the back of the sheet of metal and bend the riser upward. Once a plurality of sheets of metal are formed as outlined above they may be assembled by attaching the stringers of one sheet to the risers of another, forming a spiral staircase.

BRIEF DESCRIPTION OF THE DRAWINGS

FIG. 7 shows a isometric view of a stair.

FIG. 8 shows another isometric view of a stair.

DETAILED DESCRIPTION

Figure 1:
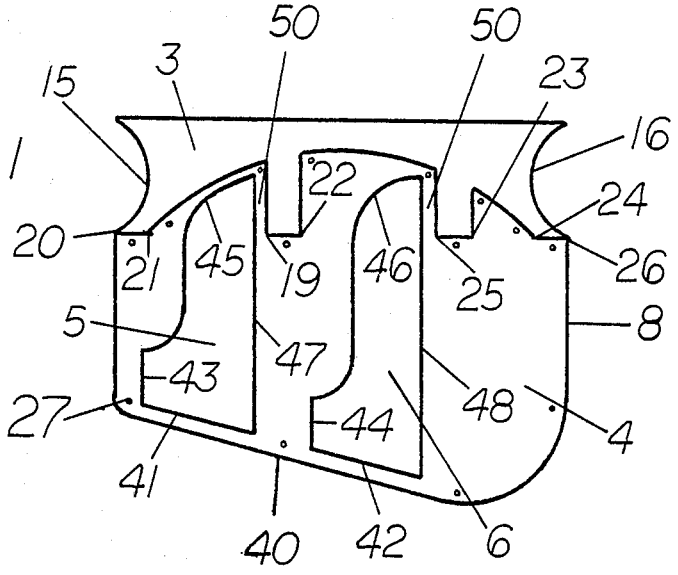
FIG. 1 shows a top view of a flat sheet of metal. It shows the cut and bend lines used to make the stair.
Figure 2:
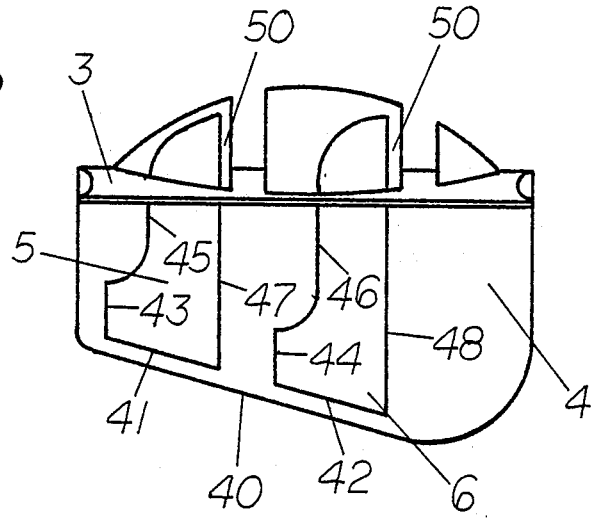
FIG. 2 shows a top view of the stair with the riser portion bent upwards.
Figure 3:
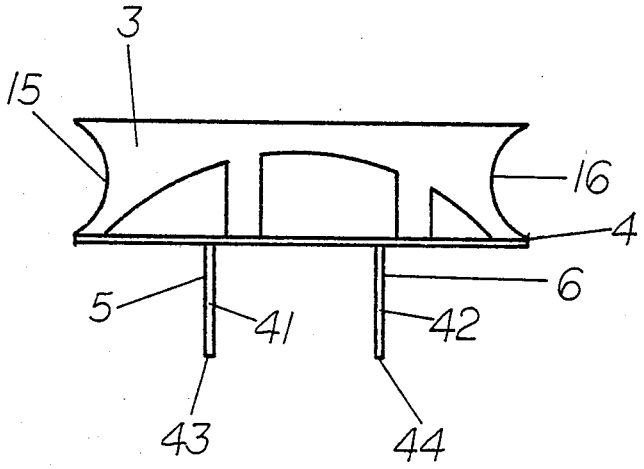
FIG. 3 shows a front view of the stair with the riser potion bent upward and the stringer portion bent downward.
Figure 4:
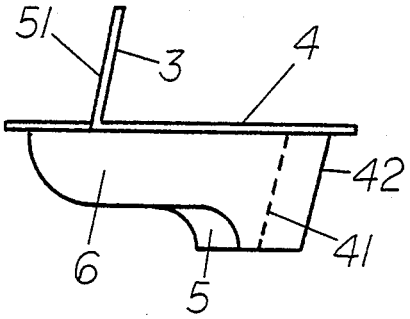
FIG. 4 shows a side view of a outside turning stair.
Figure 5:
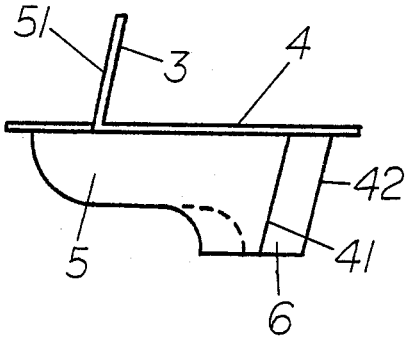
FIG. 5 shows a side view of a inside turning stair.

FIG. 1 shows a top view of a flat sheet of metal, 8. The metal is preferably a steel which can be easily cut, bent, and welded. The metal should be of a thickness such that it is strong enough to support the stairs plus a load on the stairs in excess of building code minimum standards.

Starting with a rectangular sheet metal 8, the front edge of the tread 40, must be cut at an angle. The angle chosen will depend on the arc desired in the finished staircase.

For example if a 180 degree arc is desired and there are to be 18 steps, each step would have a 10 degree angle on the front edge of the tread 40. .

It is preferred to round the corners at the front of the tread, 4.

The next step in making the stairs is to cut and bend two stringers 5 and 6 in the sheet of metal, 8. The front edges 41 and 42 of stringers 5 and 6 are cut parallel to and approximately two inches from the front edge of the tread, 40. Then the stringer bases 43 and 44 are cut parallel to the sides of the tread, 4. As will be seen later the stringer bases are cut the same length as the tread shelf 50, that they attach to. Then cuts are made to form the bottoms 45 and 46 of stringers 5 and 6. The shape of this cut may be changed to suit the style desired. Here the cut is made having two curves with a straight section in between. When the cuts are completed the stringers are bent downward along the bend lines 47 and 48 until they are perpendicular to the tread, 4. The bend lines are parallel to the sides of the tread 4, and located approximately one third of the way in from the sides of the tread.

To make the riser 3, cuts are made around the hole made by the stringer. As shown cuts are made from point 21 to point 19, from point 22 to point 25 and then from point 23 to 24. The shape of the cuts may vary just as long as the cuts don't come too close to the holes left by making the stringers. The riser is then bent up on the bend lines which are between points 20 and 21, points 19 and 22, points 25 and 23 and points 24 and 26. The riser is bent upward at an angle something more than perpendicular. The angle must be the same as the angle of the front edges of the stringers 41 and 42 because these two parts will be attached to one another. In this example case where the front edge was cut at 10 degrees the stringer will be bent upward 100 degrees, 90 degrees to get it perpendicular to the tread and an additional 10 degrees to match up with the front edge of the stringers 41 and 42.

When making the riser, as outlined above, care should be taken to leave room between the riser cut and the stringer cut for a shelf area 50. The shelf area 50 should be the same length as the base of the stringers 43 and 44 because the base of the stringer is attached to the shelf area 50, which connects the stairs together.

The height of riser 3, measured from the top of the tread to the top of the riser, is determined by the number of steps and the distance between the two floors connected by the stairs: It must be remembered that the riser is at an angle so that the vertical height is less than the risers length. Further the tread thickness must be subtracted from the height. In the example case let us say that the 18 stairs have to span a 12 foot difference between the floors. Then each riser must go up 8 inches minus the thickness of a tread. If each tread is $\frac{1}{8}$ inch thick the riser would have to have a 7 and $\frac{7}{8}$ inch height.

The length of the riser which is 10 degrees from perpendicular must then be 8 inches which is the height, 7 and $\frac{7}{8}$ inches, divided by the cosine of 10 degrees. The riser bend lines must be marked off at a distance of 8 inches from the rear edge of the tread. This distance is equal to the length of the front edge of the stringers 41 and 42.

The riser 3, is connected to the stringers' front edges 41 and 42, preferably by welding. Since the angles cut for the front edge of the stringer and the angle of the riser are the same, and the length of the stringers' front edge is the same length as the risers' length there should be a perfect fit between the two. The top of the riser should be flush with the bottom of the tread when two steps are attached and therefore the top of the riser may be welded to the bottom of the tread for added strength. FIGS. 7 and 8 taken together help illustrate how the steps are connected.

The bases of the stringers 43 and 44 are attached, preferably by welding, to the tread shelves 50. The bases should be the same length as the shelves in order to form a perfect fit. The self 50 should be wide enough to accept the base of the stringer at a slight angle corresponding to the angle of the front edge of the tread 40. This accounts for the stairs forming a spiral as it goes up.

The front edges of the stringers 41 and 42 should attach to the rear of the riser along the edge of the cut line for the riser. When this is done the base of the stringer sits on the tread shelf 50, at a diagonal using up the width of the tread shelf for a perfect fit.

An ornamental cut may be made in the sides of the riser as shown at 15 and 16.

Stringer 6 may be longer than stringer 5 since it is on the outside radius of the circle.

Since the tread has holes in it a tread cover 52, must be attached to the tread. A metal tread cover may be used or if preferred a wooden tread cover may be attached. One means of attaching a tread cover is to drill holes 27, in the tread as shown in FIG. 1 and attach the tread cover by use of bolts. If a metal tread cover is used it may be welded on. The stairs may then be carpeted to suit the decorations of the house.

When the stairs are cut and attached together as specified above a spiral staircase can be constructed out of flat pieces of metal.

Figure 6:
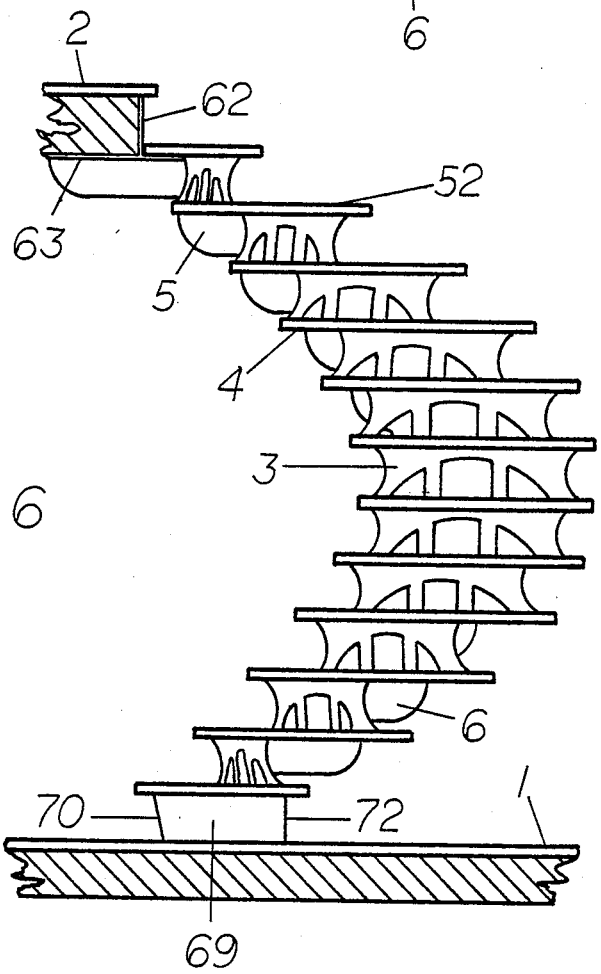
FIG. 6 shows side view an assembled staircase.
Figure 9:
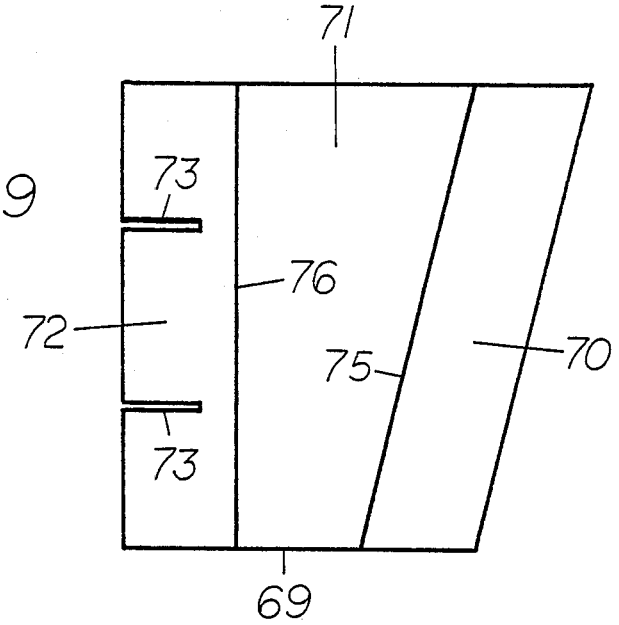
FIG. 9 shows a top view of the base.
Figure 10:
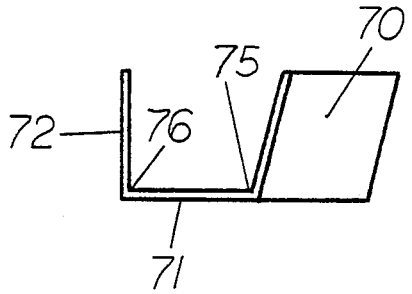
FIG. 10 shows a side view of the base.
Figure 11:
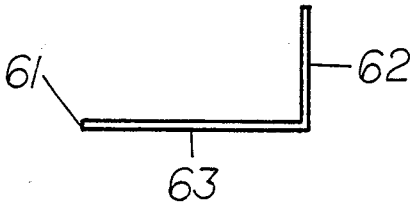
FIG. 11 shows the plate.

A base 69, as in FIGS. 6, 9 and 10 may be used to anchor the staircase to the floor 1, and for attaching the first step to. The base should have a large flat surface on its bottom 71 for attachment to the floor. The base plus the tread and cover should be the same height as a step. The base should have an angled front support 70, corresponding to a step so that the front edges of the stringers 41 and 42 can be attached to the front support 70. The front edges of the stringers for the base will be shorter than the remaining stringers because the base must be shortened by the height of the tread. The bases of the stringers 43 and 44 can be attached to the bottom of the base 71, preferably by welding. The back support 72, of the base should have notches 73 for the stringers 5 and 6 to rest on. The front support 70 and the back support 72 should have the proper height for the tread to rest on them and preferably to be welded to them.

The base may be made from a flat sheet of metal. To make the base first make the front support 70, by making a cut on the front edge of a rectangular sheet of metal at the same angle used on the front edge of tread 40, in our example case this is 10 degrees, then marking a bend line 75, parallel to the cut on the front edge of the base at a distance behind the front edge equal to the length of the front edge of the stringers 41 and 42. Then bend the front support 70 upward at the bend line 75 to an angle equal to 90 degrees minus the angle used to cut the front edge of the tread 40. Then mark a bend line 76, parallel to the rear of the sheet of metal at a distance equal to the height of a step, which in this example is 8 inches minus the thickness of the tread, and bend the rear support 72 upward 90 degrees along the bend line 76. Then make two notches 73, in the rear support 72, corresponding to the position of the stringers so that the stringers may fit into, be attached to and be supported by the rear of the base.

At the top of the stairs there is preferably a plate 61, secured to the floor for attaching the stairs to the floor. The plate should preferably have a front surface 62, for attachment to the back of the riser and a bottom surface 63, for attachment to the self of the riser. The top stair may have a riser which is bent perpendicular to the tread and cut to the height of the height of the step for easier attachment to the front surface of the plate 62.

This method is for making stairs that curve to the left as they go up. It is understood that by reversing the side on which the angle is cut on the front edge of the tread a right handed staircase may be built.

If one or more straight sections of stairs are desired the front edge of the tread 40 is left straight. Correspondingly the front edge of the stringers that they attach to are cut straight and the riser would correspondingly be perpendicular to the tread. It is possible to make a completely straight staircase using only straight sections of stairs.

By using an occasional straight section of a stair or two and then continuing the angled stairs a cone shaped spiral staircase can be made.

If desired a railing may be added to the staircase and attached to one or more treads.

By using the above method a custom fit spiral staircase can be made to an architect's specifications for any kind of structure out of flat sheets of metal.

What is claimed is:

1. A method of making a spiral staircase out of flat sheets of metal consisting of:

obtaining a plurality of rectangular sheets of metal having a front, a back and sides, shaping the sheets of metal into stairs having a tread a a riser and two stringers by, cutting the front of the sheets of metal at an angle, to form a front edge of the tread, cutting two stringers in the sheets of metal and bending each stringer downward along a bend line until it is perpendicular to the sheet of metal, cutting a riser in the sheets of metal and bending the riser upward at an angle equal to 90 degrees plus the angle used to make the cut on the front edge of the tread, when cutting the riser leaving enough space between the riser cut and the stringer cuts to form a shelf next to each bend line, attaching the stringers formed in one sheet of metal to the shelf and riser of another sheet and repeating the process until all the sheets are used, thus forming a spiral staircase, the area of the sheet of metal which remains flat becomes the tread, attaching a tread cover plate on each tread to cover holes left by forming the stringers and risers.

2. A method of making a spiral staircase out of flat sheets of metal as in claim 1 where there is a base attached to a floor and the spiral staircase is attached to the base.

3. A method of making a spiral staircase out of flat sheets of metal as in claim 1 where there is a plate attached to a floor at the top of the staircase and that plate is attached to the spiral staircase.

4. A method of making a spiral staircase out of flat sheets of metal as in claim 1 where the method of attaching the risers to the stringers and shelves is by welding.

5. A method of making a spiral staircase out of flat sheets of metal as in claim 1 where the riser has a top which attaches to the bottom of a tread by welding.

6. A method of making a spiral staircase out of flat sheets of metal as in claim 1 where the stringer and the riser have a height which is equal and where there is a base on the stringer and a shelf on the tread both having a length which is equal.

7. A method of making a spiral staircase out of flat sheets of metal as in claim 1 where the stringer bend lines are each placed on a line drawn approximately one third of the distance between the sides.

8. A method of making a spiral staircase out of flat sheets of metal consisting of:

obtaining a plurality of rectangular sheets of metal having a front, a back and sides, shaping the sheets of metal into stairs having a tread a riser and two stringers by, cutting the front of the sheets of metal at an angle, to form a front edge of a tread, marking two bend lines having a front and a back on the sheet of metal parallel to the sides of the sheet of metal each at a point one third of the distance between the two sides, starting at the front end of each bend line, cutting a stringer in the sheet of metal by making a cut parallel to the leading edge of the tread to form the front edge of the stringer, then cutting a base for the stringer parallel to the sides of the sheet of metal, cutting a bottom of the stringer so as to complete the cut for the stringer at the rear end of the bend line, then bending the stringers along the bend lines downward until they are perpendicular to the tread, marking a bend line for the riser parallel to the rear of the sheet of metal at a distance in from the rear of the sheet of metal equal to the length of the front edge of the stringer, forming the riser by making cuts from the bend line for the riser around each stringer and back to the bend line for the riser making sure that there is enough room between the stringer bend line and the riser cut for a shelf area having a surface which is equal in length to the base of the stringer and wide enough to accept the base of the stinger on its surface when the base of the stringer is attached at an angle, bending the riser upward along the bend lines to an angle equal to 90 degrees plus the angle the front edge of the tread was cut at, attaching the stairs together by welding the front edge of the stringer of one stair to the riser of another stair, and welding the base of the stinger of one stair to the shelf area of another stair, attaching a tread cover to each tread to cover the holes left in the tread by making the stringers.

9. A method of making a spiral staircase out of flat sheets of metal as in claim 8 where the riser has a top which attaches to the bottom of a tread by welding.

10. A method of making a spiral staircase out of flat sheets of metal as in claim 8 where there is a base attached to a floor and the spiral staircase is attached to the base.

11. A method of making a spiral staircase out of flat sheets of metal as in claim 8 where there is a plate attached to a floor at the top of the staircase and that plate is attached to the spiral staircase.

12. A method of making a spiral staircase out of flat sheets of metal as in claim 10 where the base has a front support and a back support of equal height and a flat section therebetween which is attached to the floor, the base is made from a flat sheet of metal having a front and a back by making a cut on the front edge of the sheet of metal at the same angle used on the front edge of the tread, then marking a bend line parallel to the cut on the front edge of the sheet of metal at a distance behind the front edge equal to the length of the front edge of the stringer, then bending the front of the base upward at the bend line to an angle equal to 90 degrees minus the angle used to cut the front edge of the tread to form the front support, marking a bend line parallel to the rear of the sheet of metal at a distance equal to the height of a step, and bending the rear of the base upward 90 degrees to form the back support, making two cuts in the rear support of the base corresponding to the position of the stringers so that the stringers will fit into, be attached to and be supported by the rear support of the base, the flat section of the base supports the base of the stringers which are attached thereto by welding, the front support of the base is attached to the front edge of the stringers by welding, the flat section of the base is attached to the floor.

* * * * *